US009240166B1

(12) United States Patent
Dunwoodie

(10) Patent No.: US 9,240,166 B1
(45) Date of Patent: Jan. 19, 2016

(54) DEVICES AND METHODS FOR MOUNTING TUNING MACHINES ON STRINGED INSTRUMENTS

(71) Applicant: David Dunwoodie, Delta, CA (US)

(72) Inventor: David Dunwoodie, Delta, CA (US)

( * ) Notice: Subject to any disclaimer, the term of this patent is extended or adjusted under 35 U.S.C. 154(b) by 0 days.

(21) Appl. No.: 14/515,275

(22) Filed: Oct. 15, 2014

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS 4,515,059 A * 5/1985 Siminoff ..... 84/306
4,643,069 A * 2/1987 Borisoff et al. ..... 84/306

FOREIGN PATENT DOCUMENTS

WO WO2014052910 A1 4/2014
WO WO 2014052910 A1 * 4/2014

* cited by examiner

*Primary Examiner* — Robert W Horn

(57) ABSTRACT

Devices and methods for mounting a tuning machine with locator pins to a stringed instrument having a mounting configuration with receiving holes that are misaligned with the tuning machines locator pins. A mounting element is provided having top and bottom surfaces and a post aperture to receive the tuning machine's post. Tuning machine alignment apertures in the top surface are in alignment with and adapted to receive the locator pins when the post is located within the post aperture, and instrument alignment elements in the bottom surface are in alignment with the receiving holes on the instrument when the post is located within the post aperture on the mounting element and the first post aperture on the instrument. The top surface complementarily receives the base of the tuning machine, and the bottom surface complementarily fits with the mounting configuration of the instrument such that the tuning machine can be secured to the mismatched instrument.

8 Claims, 6 Drawing Sheets

DEVICES AND METHODS FOR MOUNTING TUNING MACHINES ON STRINGED INSTRUMENTS

BACKGROUND OF THE INVENTION

1. Field of Invention

The present invention relates generally to systems, kits and methods for mounting tuning mechanisms on stringed instruments. More particularly, the invention relates to systems and methods for adaptively mounting diverse tuning machines on an instrument in an aligned manner without permanently modifying or altering the instrument.

2. Description of Related Art

Stringed musical instruments typically provide a fixed anchor on one end of each string and a mechanism on the other end which allows a user to establish a select amount of tension in the string. The frequency at which the string oscillates depends greatly on, among several other parameters, the vibrating length of the string and its tension. A geared mechanical mechanism used to adjust the tension of the string is often referred to as a tuning machine or machine head. Tuning machines are well known in the art, and a typical tuning machine used on guitars, banjos and the like comprises a tuning handle 12 secured to an end of a worm shaft which extends through a body 14. A worm wheel is meshed with a worm of the worm shaft inside the body 14, and a cylindrical post 16 is connected to the worm wheel and aligned with the rotational axis of the worm wheel. The cylindrical post 16 extends through a hole in the headstock of the instrument to the same side as the strings and is aligned such that its axis is generally perpendicular to the strings. In operation, as the tuning handle 12 (hence worm shaft) is rotated, it rotates the worm wheel, hence the cylindrical post 16. By this a guitar string that is inserted through a guitar string insertion hole 13 defined in the cylindrical post 16 is wound or unwound on or from the cylindrical post 16, thereby increasing or decreasing the string tension to effect tuning of the string.

There are numerous commercially available tuning machines of various designs, but most have the above common features and functions. There exists variance among past and present tuning machine manufacturers or models of tuning machines in the configuration of the connecting structures, also referred to herein as the mounting configuration, that enable the tuning machine to connect to or mate with the headstock of the particular make or model of instrument for which the tuning machine is or was intended. For example, some tuning machines 10, as shown in FIGS. 1 and 2, include one or more projections or pins 17 that extend from the bottom surface 18 of the body 14 that are received within complementary sized and aligned holes 19 provided in the instrument or headstock 20 of a guitar, banjo or the like adjacent the post receiving hole 28. With the pins 17 of the tuning machine located within the complementary holes 19 on the headstock 20, unwanted rotation or movement of the tuning machine 10 is prevented. Other variants of tuning machines may include one or more lug portions 22 that extend from the body of the tuning machine and includes a hole 24 that aligns with a hole 26 provided on the headstock 20 adjacent the hole 28 for the cylindrical post 16. A screw 31 is affixed through the hole 24 on the lug portion 22 and into the hole 26 of the headstock 20 to prevent unwanted movement or rotation of the tuning machine. Some examples of other screw reliant mounting configurations are exemplified in FIG. 5 on a model headstock: wherein the dots 32 about the post receiving hole 28 could represent holes to receive complementary projections on the body of the matching tuning machine, screws passing through the body of the matching tuning machine, or a combination of both.

Over time, tuning machines may wear or break, necessitating replacement. Furthermore, it may be desirable to replace older tuning machines with modern technologically advanced or more aesthetically pleasing units. However, a problem frequently encountered in replacing the tuning machines on a particular instrument is that of finding aftermarket tuning machines with the same mounting configuration as that of the ones being replaced so as to obviate the need to make any modifications to the instrument. For example in regard to guitars, it is sometimes difficult or impossible to obtain a desired aftermarket tuning machine with the same mounting configuration as on the units being replaced, which means that the headstock of the instrument will have to be modified by boring additional holes to match the mounting configuration of the new tuning machines, or by driving screws at new locations on the headstock to match the lugs/holes on the new tuning machines, or both. If the old holes remain visible, then they must be filled to preserve aesthetics. In many instances the owner of the instrument may be reluctant to modify the headstock in order to preserve the value of the instrument. In these cases, finding replacement tuning machines may be difficult and time consuming, or the options may be limited.

One device in the prior art that seeks to solve the above problem is a device referred to as the UMP™ (Universal Mount Plate) sold by Hipshot Products, Inc. of Interlaken, N.Y., and described and illustrated in international patent publication WO/2014/052910. The UMP™ device is an adapter plate that fits between the tuning machines and the headstock of the guitar. Tabs on the face of the plate prevent the tuning machines from slipping against the headstock. At the same time, reach nuts inserted through the existing headstock holes into the tuning machines keep the whole assembly securely in place. This means that the tuning machines, being interlocking as one unit, use the headstock holes themselves for stability rather than individual locator pins or mounting screw holes. While the UMP™ does provide a system by which flat based tuning machines can be mounted on headstocks of various mounting configurations, it nevertheless suffers from an aesthetic perspective since the plates that span several tuning machines are quite visible on the headstock, and to some instrument owners or enthusiasts, provide a somewhat unattractive appearance. In particular, guitar purists who strive to preserve the aesthetics of the instrument may consider the UMP™ device to be a less than ideal solution. There remains a need for an adapter device and method for mounting a tuning machine of one mounting configuration to the headstock of an instrument having a different mounting configuration while being minimally obtrusive visually so as to preserve the aesthetics of the instrument.

SUMMARY OF THE INVENTION

Certain deficiencies in the prior art may be overcome by the provision of systems, kits and methods for mounting tuning machines that have locator pins on the bottom of their base to a multiplicity of mounting configurations already present on the instrument. For example, a tuning machine that has two locator pins extending downward from the bottom surface of its base may be mounted on an instrument or headstock that has a mounting configuration having screw holes in the headstock for accommodating screws that pass through the tuning machine and into the headstock for providing resistance to movement and rotation.

Accordingly, in some aspects, the present invention provides a device for mounting a tuning machine, having a post and one or more adjacent locator pins, to a stringed musical instrument, having a mounting configuration with a first post aperture adapted to receiving the post and adjacent receiving holes that are misaligned with the tuning machine locator pins, the device comprising: a mounting element having an instrument facing surface, a tuning machine facing surface, and a second post aperture extending between said surfaces and configured to receive the post of the tuning machine there through; one or more tuning machine alignment apertures in the tuning machine facing surface that are in alignment with and adapted to receive therein the tuning machine locator pins when the post of the tuning machine is located within the second post aperture; one or more instrument alignment elements in the instrument facing surface that are in alignment with the receiving holes on the instrument when the post of the tuning machine is located within the second post aperture on the mounting element and the first post aperture on the instrument, whereby the tuning machine facing surface complementarily receives the base of the tuning machine, and the instrument facing surface complementarily fits with the mounting configuration of the instrument such that the tuning machine can be secured to the mismatched instrument. In some embodiments, the instrument alignment elements may comprise projections that are in alignment with and adapted to be received within the receiving holes on the instrument. In some embodiments, the instrument alignment elements may comprise one or both of notches and holes that are in alignment with the receiving holes on the instrument and adapted to engage a fastener passing through the instrument alignment element into the respective receiving hole on the instrument.

The invention further provides a method of mounting a tuning machine, having a post and one or more adjacent locator pins, to a stringed musical instrument, having a mounting configuration with a first post aperture adapted to receiving the post and adjacent receiving holes that are misaligned with the tuning machines locator pins, the method comprising: providing a mounting element having an instrument facing surface, a tuning machine facing surface, and a second post aperture extending between said surfaces and configured to receive the post of the tuning machine there through; providing one or more tuning machine alignment apertures in the tuning machine facing surface that are in alignment with and adapted to receive therein the tuning machine locator pins when the post of the tuning machine is located within the second post aperture; providing one or more instrument alignment elements in the instrument facing surface that are in alignment with the receiving holes on the instrument when the post of the tuning machine is located within the second post aperture on the mounting element and the first post aperture on the instrument, positioning the tuning machine onto the mounting element such that the post passes through the second post aperture and the locator pins are received within the tuning machine alignment apertures; positioning the tuning machine and mounting element combination onto the instrument such that the post passes through the first post aperture on the instrument and the instrument alignment element aligns with a corresponding receiving hole on the instrument; and securing the tuning machine onto the instrument, whereby the tuning machine facing surface complementarily receives the base of the tuning machine, and the instrument facing surface complementarily fits with the mounting configuration of the instrument such that the tuning machine can be secured to the mismatched instrument. In some embodiments, the instrument alignment elements may comprise projections that are in alignment with and adapted to be received within the receiving holes on the instrument, and the tuning machine and mounting element combination may be positioned onto the instrument such that the post passes through the first post aperture on the instrument and the projections align with the receiving holes on the instrument. In some embodiments, the instrument alignment elements may comprise one or both of notches and holes that are in alignment with the receiving holes on the instrument and adapted to engage a fastener passing through the instrument alignment element into the respective receiving hole on the instrument, the securing step may comprise driving a fastener through or against the instrument alignment elements and into the receiving holes on the instrument.

The components described herein are also designed to fit or retrofit most instruments without any modification to the original instrument.

Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings, which illustrate by way of example only embodiments of the invention.

DETAILED DESCRIPTION

Figure 1:
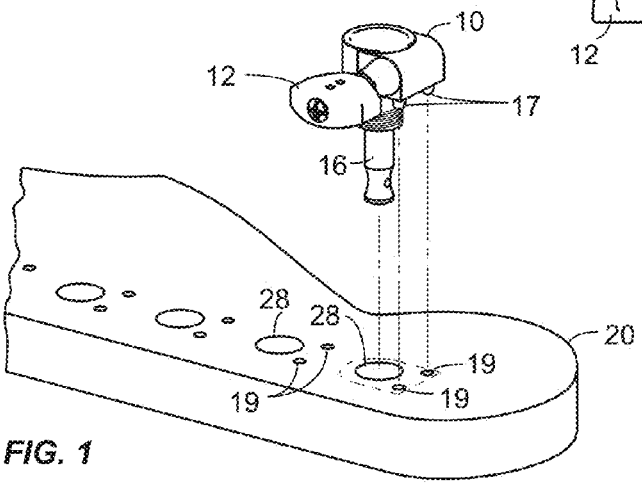
FIG. 1 is a perspective view of an exemplary guitar headstock and tuning machine having locator pins, showing the alignment of the tuning machine with respect to the headstock.
Figure 2:
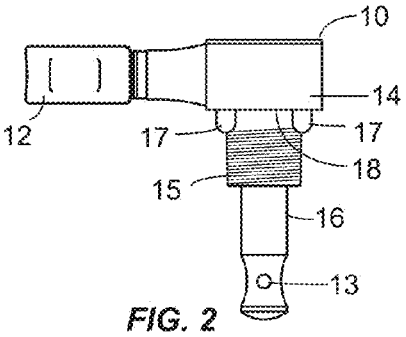
FIG. 2 is a front view of the tuning machine of FIG. 1.

Referring to FIGS. 1 and 2, there is shown a front view of a typical tuning machine 10 (FIG. 1) and a perspective view of an exemplary guitar headstock 20 and the tuning machine 10 (FIG. 2) showing the mounting alignment of the tuning machine with respect to the headstock. Tuning machines such as tuning machine 10 are well known in the art and typically comprise a tuning handle 12 secured to an end of a worm shaft (not shown) which extends through a machine head body 14. A worm wheel (also not shown) is meshed with a worm of the worm shaft inside the body 14, and a cylindrical post 16 is connected to the worm wheel and aligned with the rotational axis of the worm wheel. The cylindrical post 16 extends through a post receiving hole 28 in the headstock to the same side of the headstock as the strings, and it is aligned such that its axis is generally perpendicular to the strings. In operation, as the tuning handle 12 (hence worm shaft) is rotated, it rotates the worm wheel, hence the cylindrical post 16. By this, a guitar string that is inserted through a guitar string insertion hole 13 defined in the cylindrical post 16, is wound or unwound onto or from the cylindrical post to affect the string tension and thereby tune the string. Surrounding the cylindrical post 16 is a threaded hub 15 by which the tuning machine is secured to the headstock by a complementary nut (not shown) that engages the threads from the other side of the headstock. The above description of tuning machines is somewhat simplified for the purposes herein, but persons of ordinary skill in the art are familiar with the structures, operation and mounting of the typical tuning machines onto stringed musical instruments.

Tuning machine 10 in FIGS. 1 and 2 include a pair of projections or locator pins 17 that extend from the bottom or headstock facing surface 18 of the tuning machine body 14. The headstock in FIG. 2 includes a post hole or aperture 28 that is adapted to receive the cylindrical post 16 of the tuning machine. Adjacent to the post aperture 28 are a pair of receiving holes 19 that are complementarily located from the post aperture 28 as the locator pins 17 on the tuning machine body are located from the cylindrical post 16. The receiving holes 19 are adapted to receive the locator pins 17 of the tuning machine therein when the cylindrical post 16 of the tuning machine is fully inserted into the post aperture 28 on headstock. The number of receiving holes and their respective spacing in relation to the post aperture on the headstock is an example of a mounting configuration, which in the illustrated embodiment is one that is adapted to receive a tuning machine having a pair of locator pins along the forward facing the bottom edge of the tuning machine body. It will be apparent to the person of ordinary skill in the art that there are a variety of mounting configurations and complementary tuning machines in the marketplace.

Figure 3:
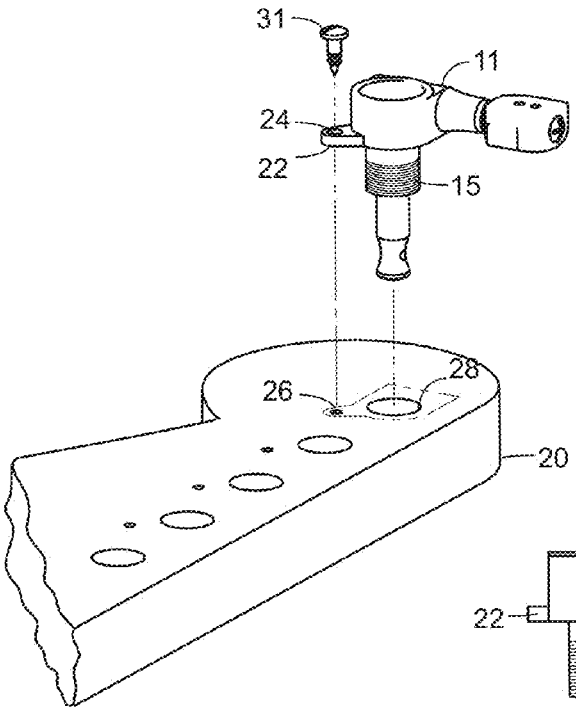
FIG. 3 is a perspective view of a guitar headstock and another variant of a tuning machine having a screw lug, showing the alignment of the tuning machine with respect to the headstock.
Figure 4:
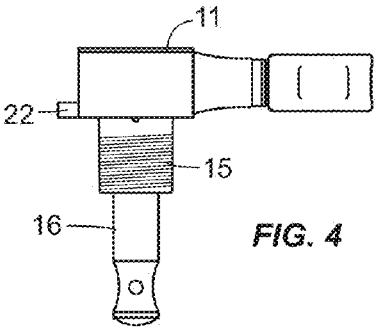
FIG. 4 is a rear view of the tuning machine of FIG. 3.

Referring to FIGS. 3 and 4, there is shown a front view of another tuning machine 11 (FIG. 4) and a perspective view of a guitar headstock 20 and the tuning machine 11 (FIG. 3) showing the mounting alignment of the tuning machine with respect to the headstock. Tuning machine 11 is similar to tuning machine 10 in FIG. 2 except for the omission of the locator pins 17 and the addition of a lug portion 22 on the body of the tuning machine that includes a hole 24 passing there through. The complementary mounting configuration on the headstock 20 comprises the post aperture 28 and an adjacent hole 26, and it is complementary to the spacing and arrangement of the hole 24 on lug 22 on the body of tuning machine 11 such that the hole 24 aligns with the hole 26 when the cylindrical post of the tuning machine 11 is fully inserted into the post aperture 28 on the headstock. A screw 31 is affixed through the hole 24 on the lug portion 22 and into the hole 26 of the headstock 20 to prevent unwanted movement or rotation of the tuning machine.

Figure 5:
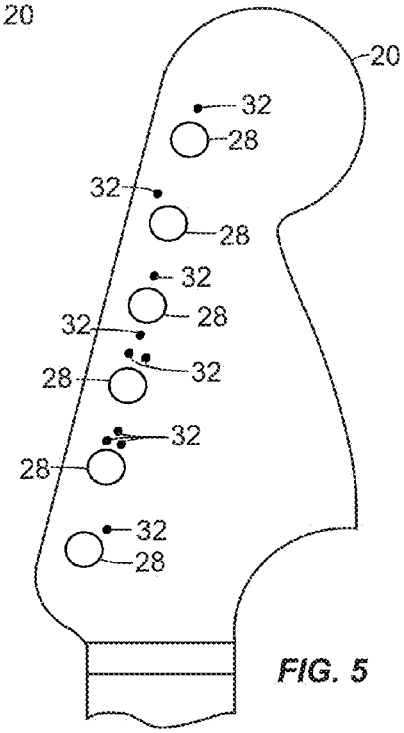
FIG. 5 is a top plan view of a guitar headstock: exemplifying a number of tuning machine mounting configurations.

Referring to FIG. 5, there is shown a top plan view of a guitar headstock 20 exemplifying a variety of common mounting configurations, each one of which requires a complementary tuning machine as a way of affixing the tuning machine to the instrument in a manner to prevent unwanted movement or rotation of the tuning machine. This is for illustrative purposes since in reality, generally only one type mounting configuration would be present on a headstock. The illustrated holes 32 about the post aperture 28 may represent receiving holes to receive complementary locator pins on the bottom surface of the matching tuning machine, or they may represent screws holes to receives screws passing through the body of the matching tuning machine, or both. As well, a person skilled in the art would recognize that there are a variety of other mounting configurations for tuning machines that are in the marketplace.

Figure 6:
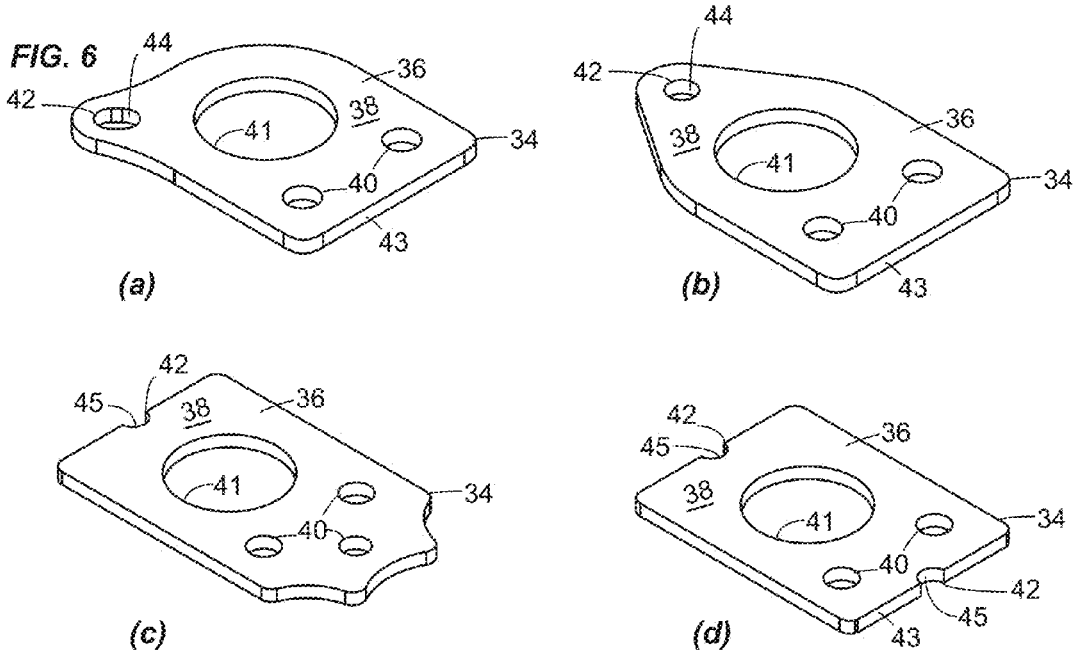
FIG. 6 comprises perspective views of several embodiments of mounting elements in accordance with the present invention on which the instrument alignment elements comprise holes (6*a* and 6*b*) or notches (6*c* and 6*d*) that align with the receiving holes on the instrument.
Figure 7:
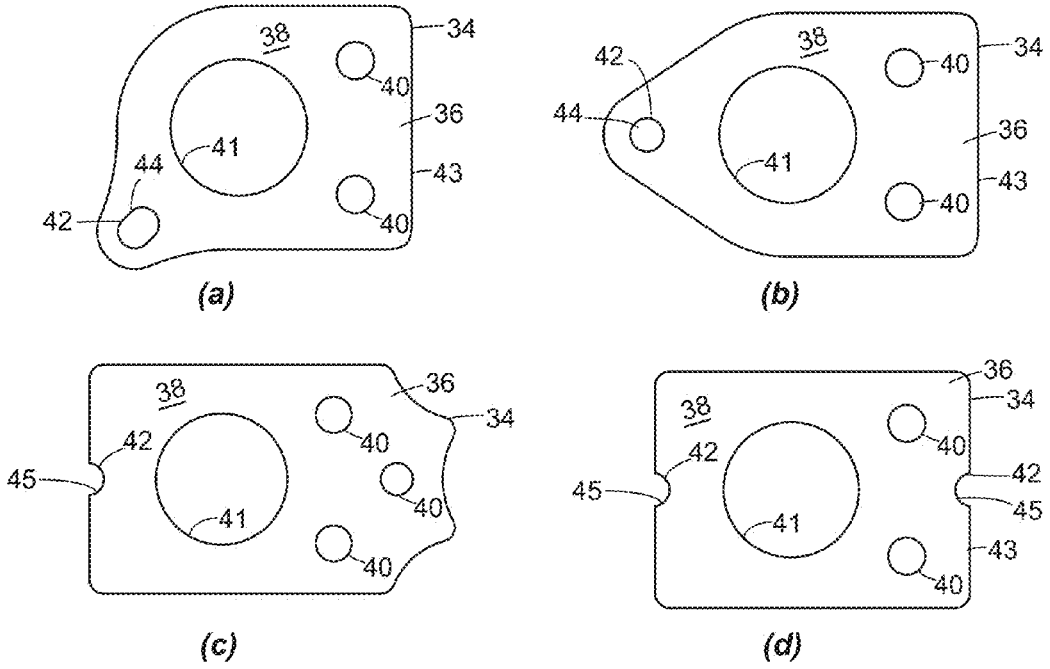
FIG. 7 comprises top plan views of the embodiments in FIG. 6.

FIGS. 6 and 7 comprise perspective and top plan views respectively of several embodiments of mounting elements 34 in accordance with the present invention, which in general comprise a plate member 36 having a top or tuning machine facing surface 38, an opposite bottom or instrument facing surface 39, and a post aperture 41 extending through the plate between the top and bottom surfaces. The post aperture 41 is configured to receive the cylindrical post 16 of a tuning machine there-through. The plate member 36 includes tuning machine alignment apertures 40 in the tuning machine facing surface 38 that are configured to be in alignment with, and adapted to receive therein, the tuning machine locator pins 17 when the post 16 of the tuning machine 10 is located within the post aperture 41. The plate member 16 also includes an instrument alignment element 42 that are configured to be in alignment with the receiving holes on the instrument when the post of the tuning machine is located within the post aperture on the mounting element and the post aperture on the instrument. In the illustrated embodiments, the instrument alignment element 42 comprises hole(s) 44 in embodiments (a) and (b) or notch(es) 45 in embodiments (c) and (d), which align with the receiving holes on the instrument that receive and engage a screw passing through the hole(s) 44 or passing in abutment with the notch(es) 45 in the plate member 16 into the instrument to prevent rotation of the plate member relative to the instrument.

Figure 8:
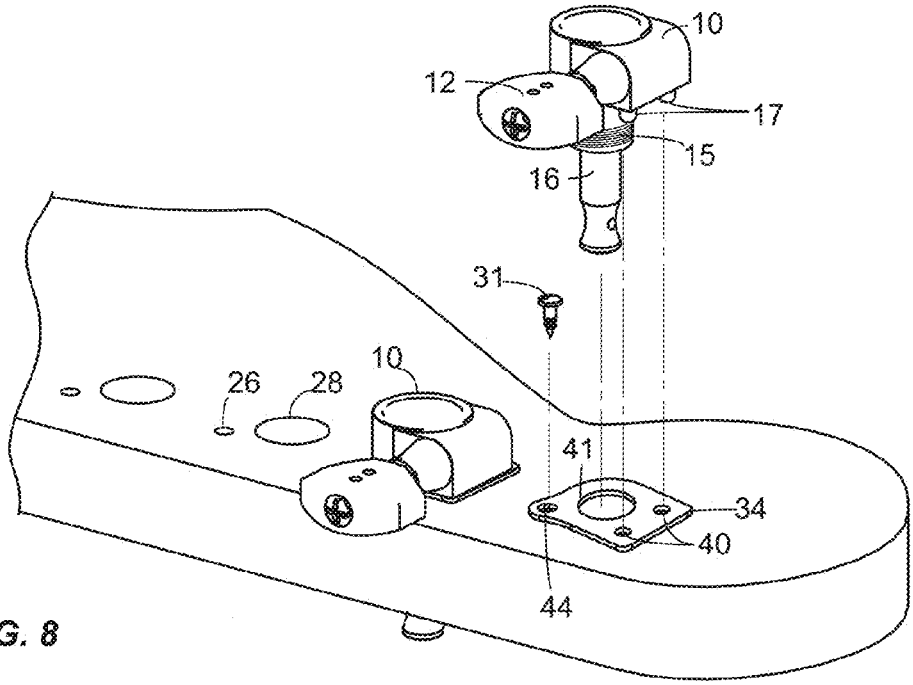
FIG. 8 is a perspective view of a guitar headstock showing the mounting arrangement of the embodiment (a) of the mounting element of FIG. 6 with a tuning machine as FIG. 1.

Referring to FIG. 8, there is shown a perspective view of a guitar headstock 20 showing the mounting arrangement of the embodiment (a) of the mounting element of FIGS. 6 and 7 with a tuning machine as shown FIG. 1. As shown, the mounting configuration on the headstock 20 has the receiving hole 26 obliquely offset to the post aperture 28. The mounting element or plate 34 of embodiment (a) has a hole 44 and post aperture 41 that are likewise offset in a manner that the holes 44 and 26 and post apertures 41 and 28 align. The tuning machine 10 includes a pair of locator pins 17 that are adjacent the forward facing edge of the tuning machine body 14. The plate element 34 of embodiment (a) likewise has a pair of alignment apertures or holes 40 in the top surface 38 that are adjacent to the forward edge 43 of the plate member. The holes 40 on the plate member are located and sized to receive the locator pins 17 of the tuning machine when the post 16 is located within the post aperture 41 on the plate member.

The mounting of the tuning machine onto the instrument is accomplished by first positioning the tuning machine onto the plate member 34 such that the post 16 passes through the post aperture 41 and the locator pins 17 are received within the holes 40 and then positioning the tuning machine and plate member combination onto the headstock such that the post passes through the post aperture 28 on the headstock and the hole 44 on the plate member aligns with receiving hole 26 on the headstock. A screw 31 is put through the hole 44 and driven into the receiving hole 26 to secure the plate member to the instrument, and then a nut is tightened onto the threaded hub 15 to secure the entire assembly onto the headstock. Advantageously, the tuning machine is prevented from rotating relative to the plate member as a result of the locator pins 17 being received within in holes 40, and the plate member is prevented from rotating relative to the headstock as a result of the screw passing through hole 44 and into the instrument. Accordingly, the plate member 34 enables a tuning machine having locator pins to be mounted to an instrument having a mismatched mounting configuration, which in the illustrated embodiment relies on a mounting screw offset from the post aperture in order to prevent rotation of the tuning machine, without necessitating any modifications to the instrument itself.

Figure 9:
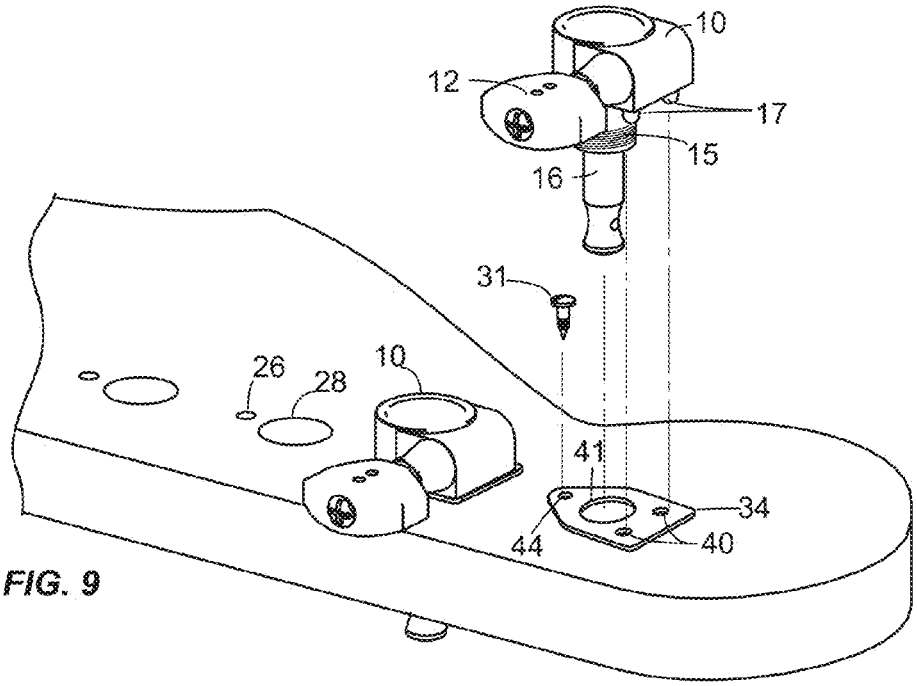
FIG. 9 is a perspective view of a guitar headstock showing the mounting arrangement of the embodiment (b) of the mounting element of FIG. 6 with a tuning machine as FIG. 1.
Figure 10:
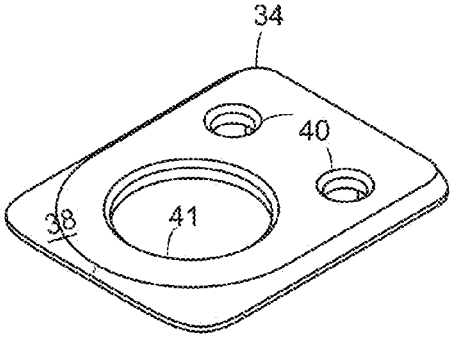
FIG. 10 is a perspective view from the top of another embodiment of a mounting element in accordance with the present invention in which the instrument alignment elements comprises projections, also referred to herein as locator pins, that align with and are received within the receiving holes on the instrument.
Figure 11:
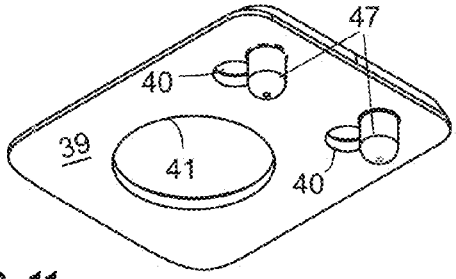
FIG. 11 is a perspective view from the bottom of the mounting element in FIG. 10.
Figure 12:
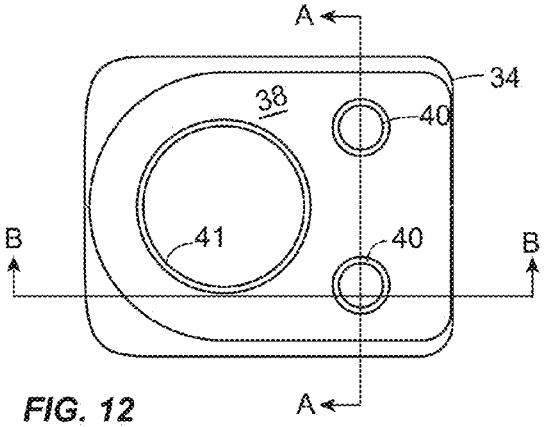
FIG. 12 is a top plan view of the mounting element in FIG. 10.
Figure 13:
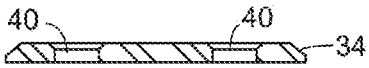
FIG. 13 is a cross-section view of the mounting element in FIG. 10 along plane A-A shown in FIG. 12.
Figure 14:
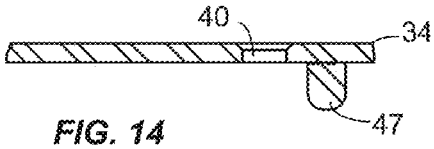
FIG. 14 is a cross-section view of the mounting element in FIG. 10 along plane B-B shown in FIG. 12.
Figure 15:
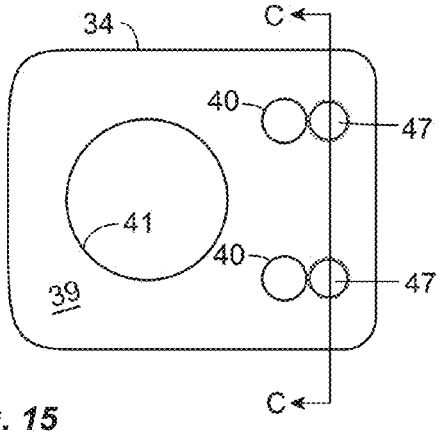
FIG. 15 is a bottom plan view of the mounting element in FIG. 10.
Figure 16:
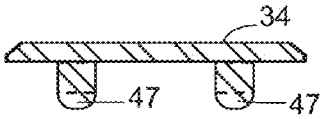
FIG. 16 is a cross-section view of the mounting element in FIG. 10 along plane C-C shown in FIG. 15.

Referring to FIG. 9, there is shown a perspective view of a guitar headstock showing the mounting arrangement of the embodiment (b) of the mounting element of FIGS. 6 and 7 with a tuning machine as shown FIG. 1. The primary difference from that shown in FIG. 8 is the location of the hole 44 relative to the post aperture 41 on the plate member 34, and consequent shape thereof, to match the location of receiving hole 26 relative to the post aperture 28 on the headstock.

Referring to FIGS. 10-16, there is shown another embodiment of present invention comprising mounting element or plate member 34 having top or tuning machine facing surface 38, opposite bottom or instrument facing surface 39, and post aperture 41 extending through the plate member between the top and bottom surfaces. The post aperture 41 is configured to receive the cylindrical post 16 of a tuning machine therethrough. The plate member 34 includes a pair of tuning machine alignment apertures 40 in the tuning machine facing surface 38 that are configured to be in alignment with, and adapted to receive therein, the tuning machine locator pins 17 when the post 16 of the tuning machine 10 is located within the post aperture 41. The plate member 34 also includes a pair of instrument alignment elements that are configured to be in alignment with receiving holes on the instrument when the post of the tuning machine is located within the post aperture on the mounting element and the post aperture on the instrument. In the illustrated embodiment, the instrument alignment elements 42 comprise a pair of projections or locator pins 47 that extend downward from the bottom surface 39 of the plate member, and that are in alignment with complementary receiving holes 19 on the headstock that receive the locator pins 47.

Figure 17:
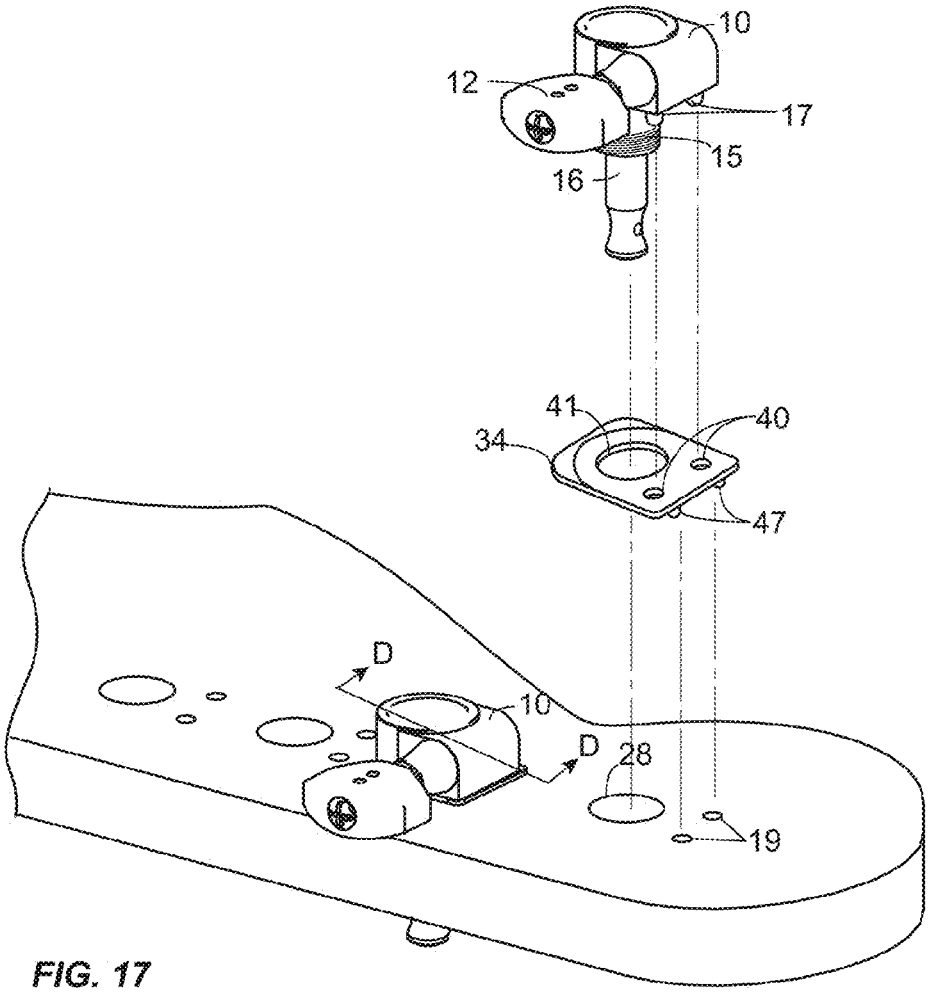
FIG. 17 is a perspective view of a guitar headstock showing the mounting arrangement of embodiment of the mounting element of FIGS. 10-16 with a tuning machine of FIG. 1.
Figure 18:
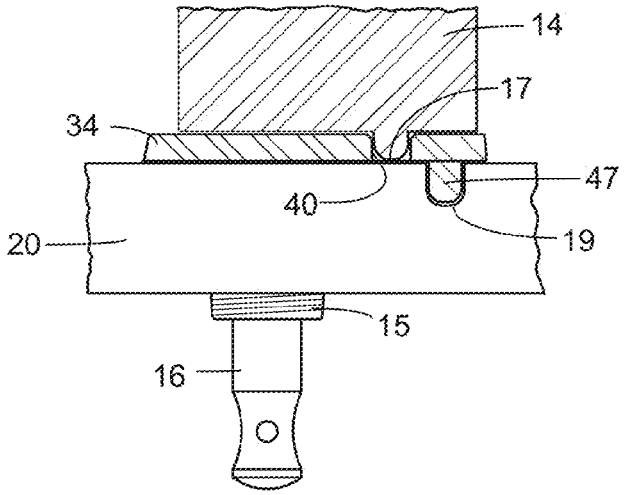
FIG. 18 is a cross-section view of the tuning machine and mounting element affixed on the headstock in FIG. 17 along plane D-D shown in FIG. 17.

With reference to FIGS. 17 and 18, the mounting of the tuning machine in the embodiment in FIG. 10-18 onto the instrument is accomplished by first positioning the tuning machine onto the plate member 34 such that the post 16 passes through the post aperture 41 and the locator pins 17 are received within the holes 40, and then positioning the tuning machine and plate member combination onto the headstock 20 such that the post passes through the post aperture on the headstock and the locator pins 47 on the bottom surface of the plate member 34 align with receiving holes 19 on the headstock. Then a nut is tightened onto the threaded hub 15 to secure the entire assembly onto the headstock. Advantageously, the tuning machine is prevented from rotating relative to the plate member as a result of the locator pins 17 being received within in holes 40, and the plate member is prevented from rotating relative to the headstock as a result of the locator pins 47 being received within in receiving holes 19 on the headstock. Accordingly, the mounting element 34 enables a tuning machine having locator pins of one configuration to be mounted to an instrument having a mismatched mounting configuration with receiving holes 19 that do not align directly with the locator pins 17 on the tuning machine, without necessitating any modifications to the instrument itself.

In order to achieve a pleasing visual appearance of the mounted assembly, the plate member of some embodiments may be sized to closely match the footprint of the corresponding tuning machine (as illustrated) so as to produce minimal visual impact. Additionally or alternatively, the material and finish of the plate member may be chosen to correspond to the overall look of the instrument or mimic the hardware to preserve a specific aesthetic attribute (vintage, color, etc.) of the instrument.

Figure 19:
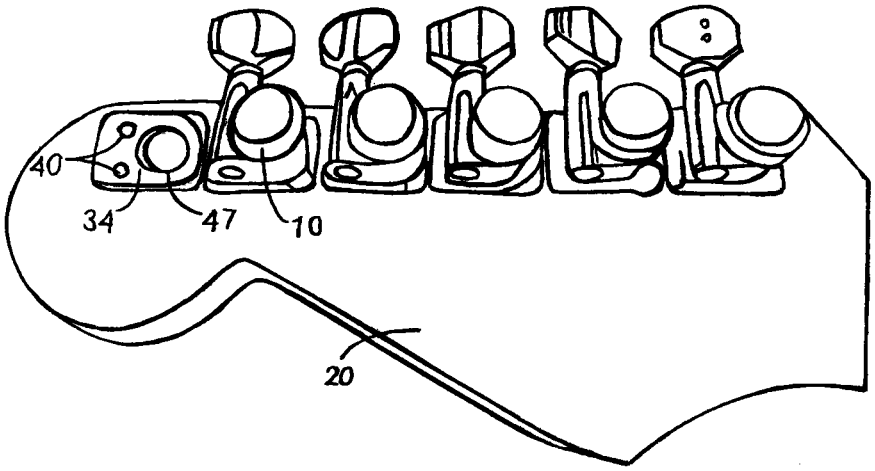
FIG. 19 is a perspective view of a guitar headstock with a set of tuning machines mounted thereon by means of the embodiment of the mounting elements shown in FIGS. 10-16.

Referring to FIG. 19, there is shown a guitar headstock with a set of tuning machines mounted thereon by means of the embodiment of the mounting elements shown in FIGS. 10-16, illustrating that a clean and aesthetically pleasing look can be achieved in which the mounting elements of the present invention produce minimal visual impact on the overall appearance of the mounted tuning machines.

While several embodiments of mounting elements in accordance with the present invention are shown and described, each configured to conform with one of several tuning machine mounting configurations often found on instruments, it is nevertheless contemplated that the number, size, location and spacing of one or both of the tuning machine alignment apertures 40 and the instrument alignment elements 42, with respect to the post aperture 41, may by varied so that other embodiments of the present invention may be derived that adapt tuning machine locator pin configurations to otherwise mismatching instrument mounting configurations, which have not been illustrated herein.

While the above description and illustrations constitute preferred or alternate embodiments of the present invention, it will be appreciated that numerous variations may be made without departing from the scope of the invention. Thus, the embodiments described and illustrated herein should not be considered to limit the invention as construed in accordance with the accompanying claims.

What is claimed is:

1. A device for mounting a tuning machine having a post and one or more adjacent locator pins to a stringed musical instrument having a mounting configuration with a first post aperture adapted to receiving the post and adjacent receiving holes that are misaligned with the tuning machines locator pins, the device comprising:

a. a mounting element having an instrument facing surface, a tuning machine facing surface, and a second post aperture extending between said surfaces and configured to receive the post of the tuning machine there through;

b. one or more tuning machine alignment apertures in the tuning machine facing surface that are in alignment with and adapted to receive therein the tuning machine locator pins when the post of the tuning machine is located within the second post aperture;

c. one or more instrument alignment elements in the instrument facing surface that are in alignment with the receiving holes on the instrument when the post of the tuning machine is located within the second post aperture on the mounting element and the first post aperture on the instrument, wherein the tuning machine facing surface complementarily receives the base of the tuning machine, and the instrument facing surface complementarily fits with the mounting configuration of the instrument such that the tuning machine may be secured to the mismatched instrument.

2. The device as claimed in claim 1, wherein the instrument alignment elements comprises projections that are in alignment with and adapted to be received within the receiving holes on the instrument.

3. The device as claimed in claim 1, wherein the instrument alignment elements comprises one or both of notches and holes that are in alignment with the receiving holes on the instrument and adapted to engage a fastener passing through the instrument alignment element into the respective receiving hole on the instrument.

4. The device of claim 2 wherein the mounting element is a plate shaped to closely match the footprint of the tuning machine body when the device and tuning machine are mounted on the instrument.

5. The device of claim 3 wherein the mounting element is a plate shaped to closely match the footprint of the tuning machine body when the device and tuning machine are mounted on the instrument.

6. A method of mounting a tuning machine, having a post and one or more adjacent locator pins, to a stringed musical instrument, having a mounting configuration with a first post aperture adapted to receiving the post and adjacent receiving holes that are misaligned with the tuning machines locator pins, the method comprising:

a. providing a mounting element having an instrument facing surface, a tuning machine facing surface, and a second post aperture extending between said surfaces and configured to receive the post of the tuning machine there through;

b. providing one or more tuning machine alignment apertures in the tuning machine facing surface that are in alignment with and adapted to receive therein the tuning machine locator pins when the post of the tuning machine is located within the second post aperture;

c. providing one or more instrument alignment elements in the instrument facing surface that are in alignment with the receiving holes on the instrument when the post of the tuning machine is located within the second post aperture on the mounting element and the first post aperture on the instrument, d. positioning the tuning machine onto the mounting element such that the post passes through the second post aperture and the locator pins are received within the tuning machine alignment apertures;

e. positioning the tuning machine and mounting element combination onto the instrument such that the post passes through the first post aperture on the instrument and the instrument alignment element aligns with a corresponding receiving hole on the instrument; and f. securing the tuning machine onto the instrument, whereby the tuning machine facing surface complementarily receives the base of the tuning machine, and the instrument facing surface complementarily fits with the mounting configuration of the instrument such that the tuning machine can be secured to the mismatched instrument.

7. The method as claimed in claim 6, wherein the instrument alignment elements comprises projections that are in alignment with and adapted to be received within the receiving holes on the instrument, and step (e) comprises positioning the tuning machine and mounting element combination onto the instrument such that the post passes through the first post aperture on the instrument and the projections align with the receiving holes on the instrument.

8. The method as claimed in claim 6, wherein the instrument alignment elements comprises one or both of notches and holes that are in alignment with the receiving holes on the instrument and adapted to engage a fastener passing through the instrument alignment element into the respective receiving hole on the instrument, wherein step (f) comprises driving a fastener through or against the instrument alignment elements and into the receiving holes on the instrument.

* * * * *